US005601517A

United States Patent [19]

Haber et al.

[11] Patent Number: 5,601,517

[45] Date of Patent: Feb. 11, 1997

[54] ARM EXERCISE DEVICE

[76] Inventors: Terry M. Haber, 25011 Castlewood, El Toro, Calif. 92630; William H. Smedley, 33285 Blanche Dr., Lake Elsinore, Calif. 92330; Clark B. Foster, 23631 Wakefield Ct., Laguna Niguel, Calif. 92677

[21] Appl. No.: 264,708

[22] Filed: Jun. 23, 1994

[51] Int. Cl.[6] ..... A63B 21/04

[52] U.S. Cl. ..... 482/121; 482/905; 482/129; 482/22

[58] Field of Search ..... 482/905, 121, 482/122, 129; 601/40, 33; D8/51; 100/902, 266; D21/191, 198

[56] References Cited

U.S. PATENT DOCUMENTS 3,735,983 5/1973 Ortiz ..... 482/905
4,131,275 12/1978 Gandy et al. ..... 482/905
4,603,857 8/1986 Chipman et al. ..... 482/905
5,364,323 11/1994 Liu ..... 482/124

*Primary Examiner*—Jerome Donnelly
*Attorney, Agent, or Firm*—Morland C. Fischer

[57] ABSTRACT

The force resistance device of the present invention enables the muscle groups which rotate the humerus about its axis to be safely and adequately developed. A base provides a series of rollers in a radial configuration which enables the humerus to rotate about its own axis. The device protectingly surrounds the elbow and lies adjacent the radius and ulna portions of the arm. Tension cords which may be selected based upon number and individual tension characteristics extend from an elongate portion to the base portion and about the curved portion which protects the elbow.

9 Claims, 5 Drawing Sheets

ARM EXERCISE DEVICE

FIELD OF THE INVENTION

The present invention relates to the field of exercise and physical therapy equipment. More specifically, the present invention relates to a device for efficient isolation on and development of the muscles of the arm which are used to rotate the humerus about its axis without causing translation in a direction normal to the axis.

BACKGROUND OF THE INVENTION

Force resistance devices for human muscular development have been known in the art for some time. These devices, also known as exercise and physical therapy devices, are employed for a variety of purposes. In some instances, the devices are designed to put the user into general overall muscular shape. In other instances, the devices are designed to concentrate upon a single group of muscles to strengthen that particular group. In other instances still, the purpose of the device is to strengthen or protect damaged tissue, or increase activity in a damaged area, to provide physical therapy.

With regard to devices for strengthening the hands and arms, several such devices are known. In some exercise equipment, the user sits against a back board and brings a pair of mechanical members together by forcing his elbows together. This specific action exercises some muscles of the arm and the chest.

In another technique, bar bells or free weights may be lifted by the user while the user is in a variety of positions. If the user is lying on his side, and attempts to rotate a bar bell from a position where his radius and ulna is parallel to the ground to a position where the radius and ulna is perpendicular to the ground, the user will not get an even workout. The axial force against which the humerus turns will give high resistance at the outset, and virtually zero resistance once the weight is brought to its highest position.

Likewise, if the user is sitting upright, and leans slightly to the right to pick a weight up from a horizontal surface, it may be beyond the range of movement of the arm. Even if the weight can be picked up, the resistance will be uneven. This is due to the law of sines and cosines which dictates the that the torque on the humerus will be a function of the angle of the radius and ulna with respect to the vertical gravitational pull of the earth.

This same principle holds true where the hand engages a handle attached to a cord under tensile force. As the radius and ulna rotate with respect to the humerus the same sine and cosine relationship dictate the torque force transmitted to the humerus. This uneven application of force can damage muscles and impede an even and healthy progression of development.

Further, where the muscles engage a force which is high at the first moment of movement, the muscles may strain the ligaments and become sprained. Although the total resistance and weight can be adjusted, the force application versus displacement will retain the same ungainly, uneven force characteristics.

Another problem with arm exercise equipment is its size, weight, and lack of portability. The arms are second only to the legs in the force that is required for proper development. Weights used to develop the arms, or machines which use the force of weights are of necessity heavy and difficult to transport. Most do not have the ability to adequately isolate on desired muscle groups. Portability can be a severe limitation on the utilization of an exercise device. Non-portability translates predominantly into use in one location, which due to the mobility of the users limits the occasion to use the exercise device.

Another disadvantage regarding commonly available exercise equipment for the arms, is the protection afforded the elbow. When the force is applied through the human hand, there is a competition between the engagement of two sets of muscles, namely those directing the radius and ulna, and those directing the humerus. In cases of high strain, the high force from one muscle group can transfer to another as the arm strains. This can cause the elbow to move suddenly as the muscle groups adjust to apply the maximum force to the hand. Such rapid and unexpected movement of the elbow can cause injury, not only by straining of the muscles in an unexpected force shift, but the elbow can become injured by striking surfaces nearby. The injury from elbow impact is particularly dangerous, and defeats the purpose for which exercise was sought.

Another disadvantage with commonly available equipment which encourages the humerus to rotate will usually encourage rotation about an axis which is significantly displaced from the axis of the humerus. In other cases, the movement is encouraged about an axis which is not even parallel with the axis of the humerus. In both of these cases the arm may be encouraged to move in a manner which presses the range of motion allowed by the bones of the arm. This can cause severe and long term damage to the joints.

In addition, no device has yet shown a good effectiveness in strengthening the muscles associated with angular displacement of the humerus along its axis, such as is required in arm wrestling. Arm wrestling requires a good grip, and adequate pectoral development, but is especially dependent upon the muscles which produce angular displacement of the humerus, along its axis. Presently available exercise equipment does not adequately focus upon this muscle group.

What is therefore needed is an exercise device which concentrates on the muscle groups which enable the humerus to move about its axis, or axis as closely as possible coaxial with respect to the humerus. The device should deliver a more even force versus displacement profile to evenly spread power throughout the angular displacement of the humerus. The needed device should be simple, light weight, and adjustable with regard to the opposing force. The needed device should not require special considerations to facilitate its use. The needed device should be utilizable with ordinary human surroundings and not require excessive space. The needed device should provide protection to the elbow and virtually eliminate the possibility of contact-type injury. The device should enable rotation of the humerus about an axis as close to the axis of the humerus, and as parallel to the axis of the humerus as possible.

SUMMARY OF THE INVENTION

The force resistance device of the present invention enables the muscle groups which rotate humerus about its axis to be safely and adequately developed. A base provides a radially placed configuration of rollers which engage a constant radius portion of a pivoting member. The device protectingly surrounds the elbow and lies adjacent the radius and ulna portions of the arm. Tension cords extend from an elongate portion to the base portion and about the curved portion which protects the elbow.

These tension cords are carried on rollers to insure that deleterious rubbing friction in eliminated. The tension cords are multiple and parallel oriented such that one or more can be engaged to provide varying resistance. Further, cords of varying resistance can be provided to further vary the tension and therefore the force against which the user moves. The tension cords have enlarged ends which engage notches formed in brackets, one bracket associated with the base, the other bracket associated with the elongate pivotable member.

A handle is mounted at a comfortable angle, and enables the hand's grip to be utilized and stressed during the exercising of the arm. The device generally stresses the arm muscles as the radius and ulna part of the arm is brought from a generally vertical position at about the 12 o'clock position, counterclockwise to the 9 o'clock position. The invention is valuable for strengthening in a safe manner the muscles associated with angular displacement along the axis of the humerus. Further, the invention is utilizable to strengthen the muscle groups used in arm wrestling.

BRIEF DESCRIPTION OF THE DRAWINGS

The invention, its configuration, construction, and operation will be best further described in the following detailed description, taken in conjunction with the accompanying drawings in which.

DETAILED DESCRIPTION OF THE PREFERRED EMBODIMENT

Figure 1:
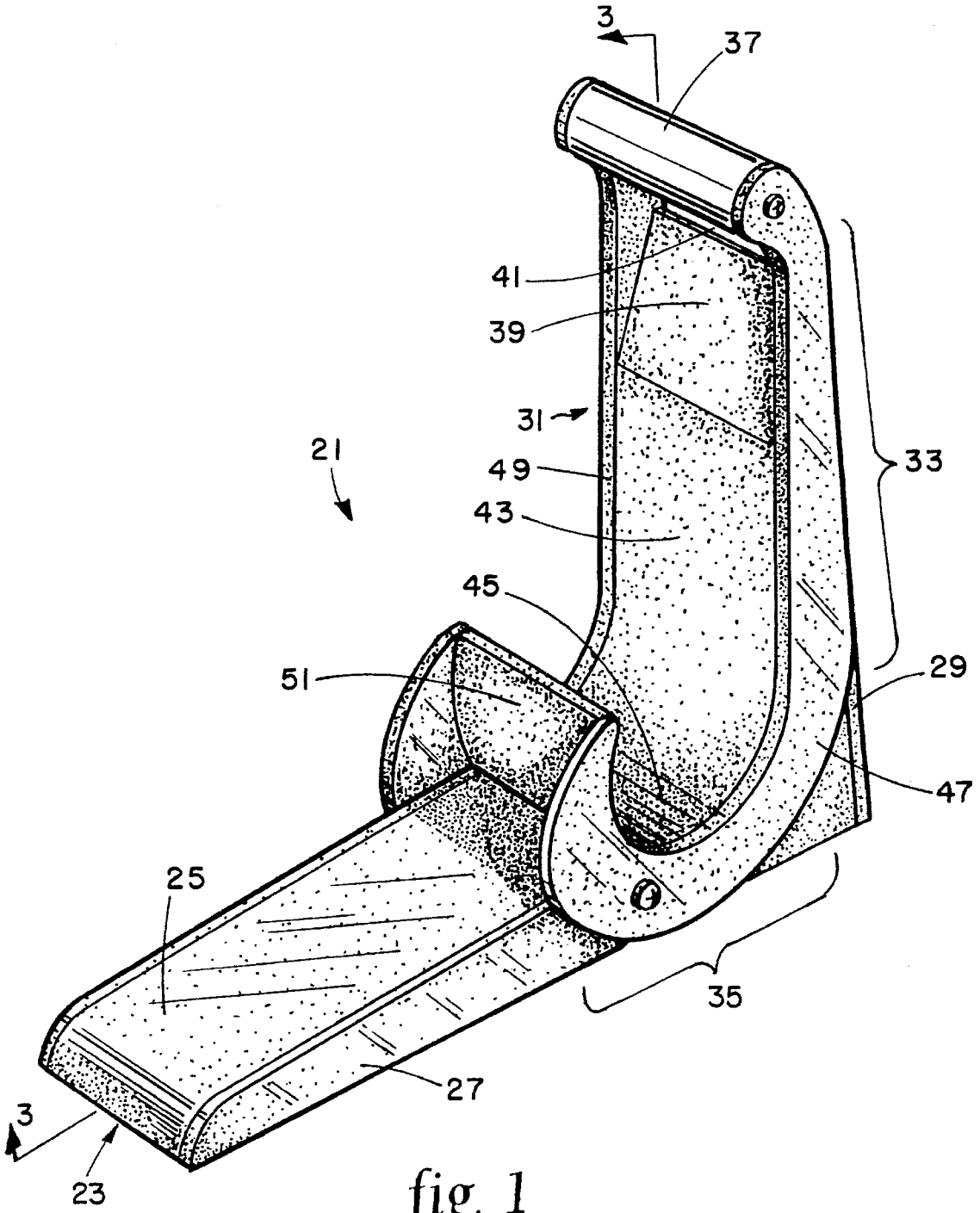
FIG. 1 is a perspective view of the exercise device of the present invention illustrating the pivoting member atop the fixed base.

The description and operation of the invention will be best described with reference to FIG. 1. FIG. 1 is a perspective view of an exercise device 21 as it would be viewed by a human approaching the device 21 to exercise the right arm. The exercise device 21 has a fixed base 23 having an upper surface 25, side surfaces 27, and a back surface 29. The fixed base 23 pivotally supports a pivoting member 31. Pivoting member 31 has an elongate portion 33 and a curved portion 35. Pivoting member is designed to pivot about an axis at the center of the area partially curvingly enclosed by the curved portion 35.

Atop elongate portion 33 is a hand grip 37. A slanted back wall 39 opens to a hand opening 41 to enable the human hand to enter the hand opening and the fingers to grasp the hand grip 37. Accommodation of the hand with the slanted back wall 39, and a straight portion 43 enables the radius and ulna portions of the arm, and the back of the hand to be maximally supported once the human arm is placed within the confines of the pivoting member 31.

Just beneath, and continuous with the straight portion 43 is the arm-rest curved portion 45. Arm-rest curved portion 45 defines the space into which the lower portion of the humerus is placed and ensures that the human arm will be stabilized and unable to shift from a position in which the axis of the humerus coincides with the axis of pivot of the pivoting member 31.

All of the structures of the pivoting member 31, including the hand grip 37, slanted back wall 39, straight portion 43, and arm rest curved portion 45 are bound by a first side flange 47 and a second side flange 49. The side flanges 47 and 49 fix the pivoting member 31, with respect to movement in the axis of pivot, relative to the fixed base 23.

Also shown in FIG. 1 is a portion of a radially outward surface 51 which is the outside of the arm-rest curved portion 45. This surface will experience the bulk of the bearing force placed upon the pivoting member 31 as it is pivoted with respect to fixed base 23.

Figure 2:
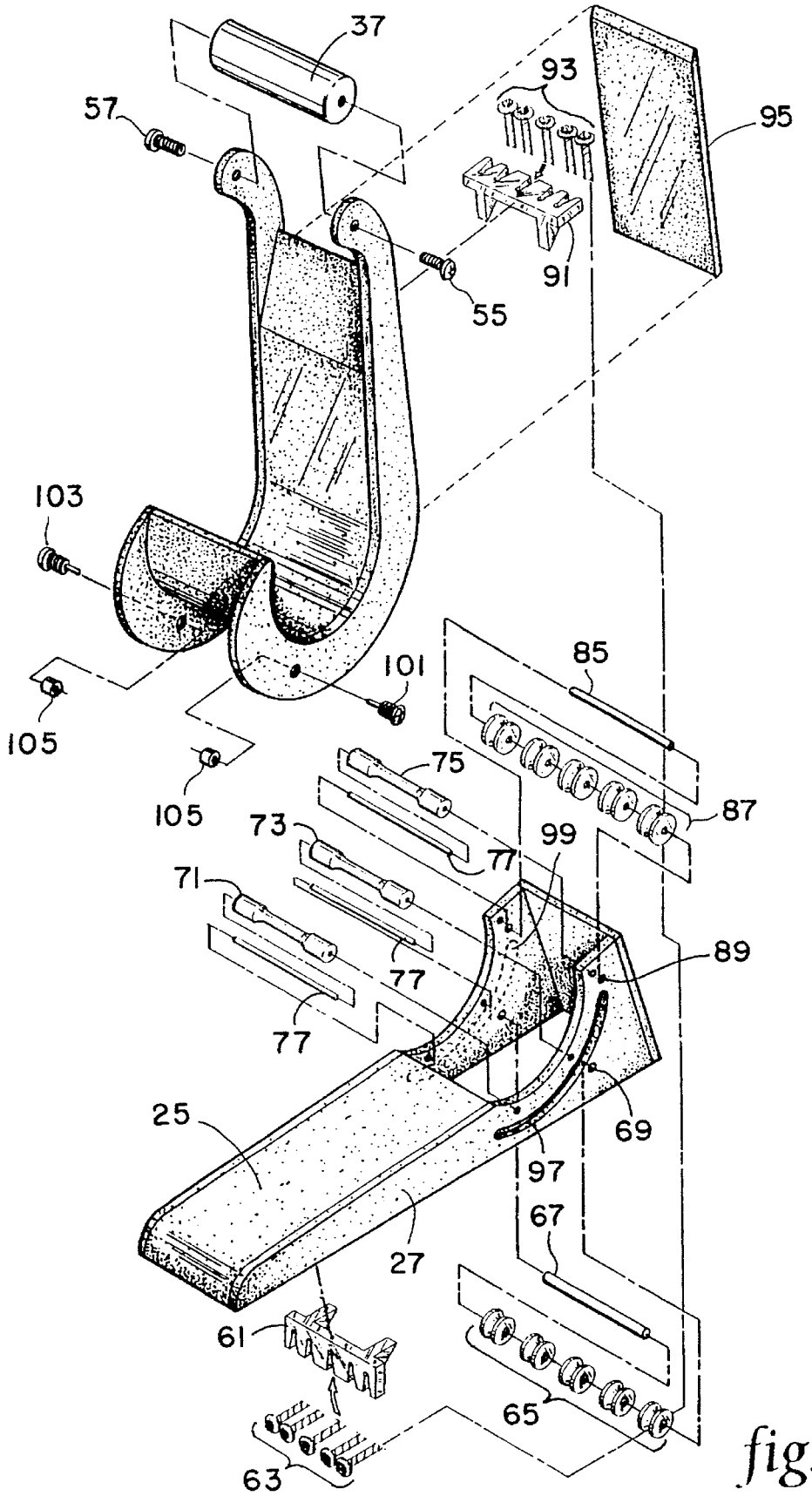
FIG. 2 is an exploded view of the exercise device of FIG. 1, and illustrating its component parts.

Referring to FIG. 2, an overall exploded view of the exercise device 21 is shown. As can be seen, the pivoting member 31 is generally formed into a single piece. A first handle screw 55 and a second handle screw 57 extend through the side flanges 47 and 49 to fix the hand grip 37 with respect to the pivoting member 31.

Referring to the lowermost portion of FIG. 2, a base elastic rope bracket 61 is shown detached from the fixed base 23. The elastic rope bracket 61 may be welded or bolted to the base 23, or attached by any manner sufficient to secure the forces to which it will be subjected. Also visible, and shown in broken fashion, are a set of elastic cord lower ends 63. Elastic cord lower ends 63 extend to a broken line indication of discontinuity in order to simplify the appearance of the exploded view of FIG. 2.

Although not shown, the lengths of the elastic cords are intended to bear against a set of lower elastic cord rollers 65. The set of lower elastic cord rollers 65 are commonly and rotatably supported by a lower elastic cord roller axle 67. The lower elastic cord rollers 65 will preferably be made of TEFLON or some other low friction material. The material should be designed with the lower elastic cord roller axle 67 in mind to give long service with minimum wear.

Also now visible on the fixed base 23 is the lower elastic cord roller axle apertures 69. The apertures 69 support and fix the axle 67 with respect to the fixed base 23. Axle 67 may be fixed by press fitting or with the use of screws or bolts (not shown).

Shown displaced slightly upwardly and to the left of the fixed base 23 are a set of three roller bearings, namely lower roller bearing 71, middle roller bearing 73 and upper roller bearing 75. Each of the roller bearings 71, 73 and 75 are supported by an associated one of the roller bearing axles 77 shown adjacent them. The roller bearing axles 77 engage the roller bearing axle apertures 79 in the sides of the fixed base 23. Again, the roller bearings 71, 73, and 75 will preferably be made of TEFLON or some other low friction material. The roller bearing material should be designed with the roller bearing axles 77 in mind to give long service with minimum wear.

On the fixed base 23, and in particular the side surfaces 27, a pair of upwardly disposed curved surfaces 81 are shown. The curvature of the curved surfaces 81 matches the radially outward surface 51 on the pivoting member 31.

In the middle portion of FIG. 2, and slightly above the fixed base 23 is an upper elastic cord roller axle 85 shown to engage a set of upper elastic cord rollers 87. The lengths of the elastic cords are intended to also bear against the upper elastic cord rollers 87. As was the case for the lower elastic cord rollers 65, the upper elastic cord rollers will preferably be made of TEFLON or some other low friction material, and designed with the upper elastic cord roller axle 85 in mind to give long service with minimum wear.

Also now visible on the fixed base 23 is the upper elastic cord roller axle apertures 89. The apertures 89 support and fix the axle 85 with respect to the fixed base 23. As was the case for axle 67, axle 85 may be fixed by press fitting or with the use of screws or bolts (not shown).

At the upper portion of FIG. 2 is the elongate portion elastic rope bracket 91. Bracket 91 is similar to bracket 61, and is affixed to the pivoting member 31 in a manner similar to that to which the bracket 61 was affixed to the fixed base 23. Shown adjacent to bracket 91 are the elastic cord upper ends 93. The length of the elastic cords (not shown in their entirety) extend between the upper ends 93 and the lower ends 63. Five cord ends, both upper cord ends 93 and lower cord ends 63 are shown, however it is understood that the exercise device 21 of the present invention may be built to accommodate a greater or lesser number of the elastic cords. Further, not all of the elastic cords need be utilized in the exercise device 21, and it is contemplated that both the number and strength of the cords may be selectively employed to yield the desired resistance characteristics.

The rear side of the pivoting member 31 is shown fitted with a cover plate 95 to isolate the elastic rope bracket 91 from view and to protect it from interference with outer structures. The bottom of fixed base 23 may optionally also be covered with a cover plate, but since it is not in view during the use or storage of the exercise device 21, such is not considered necessary.

As can be seen on fixed base 23 there is a first base radiused slot 97 and a second base radiused slot 99. Both the first and second radiused slots 97 and 99 may generally follow the curvature of the pair of upwardly disposed curved surfaces 81. As is shown in connection with the pivoting member 31, a pair of bearing screws, bolts, or rivets, which will hereafter be referred to as screws, namely first radiused slot bearing screw 101 and second radiused slot bearing screw 103 engage the first and second side flanges 47 and 49. When the first and second radiused slot bearing screws 101 and 103 engage the side flanges 47 and 49 while the pivoting member 31 is in engaged position with the fixed base 23, the ends of the first and second radiused slot bearing screws 101 and 103 will extend through and laterally engage the first and second base radiused slots 97 and 99.

This engagement of the first and second radiused slot bearing screws 101 and 103 with respect to the first and second base radiused slots 97 and 99 act to both hold the pivoting member 31 in place with respect to the fixed base 23 and to guide the pivoting action of the pivoting member 31. The exercise device 21 is tolleranced such that downward force on the pivoting member is borne by the radially outward surface 51 on the lower, middle, and upper roller bearings 71, 73, and 75 rather than upon the first and second radiused slot bearing screws 101 and 103. The only force which should be experienced by the first and second radiused slot bearing screws 101 and 103 will be only the force necessary to keep the pivoting member 31 from lifting away from the fixed base 23.

The tip ends of the first and second radiused slot bearing screws 101 and 103 should be made to move within the first and second radiused slots 97 and 99 in a manner which is as friction free as possible. One possible manner to accomplish this would be to use small, precision roller bearings 105 at the ends of the bearing screws 101 and 103, to roll against the radiused slot 97 and 99. The tip portions of the screws 101 and 103 may be fitted with threads to accept the bearings 105, and a stop, in the form of a stepped land, as is shown in FIG. 2, to form the maximum extend of threaded engagement. Other solutions may involve low friction interface materials.

Figure 2A:
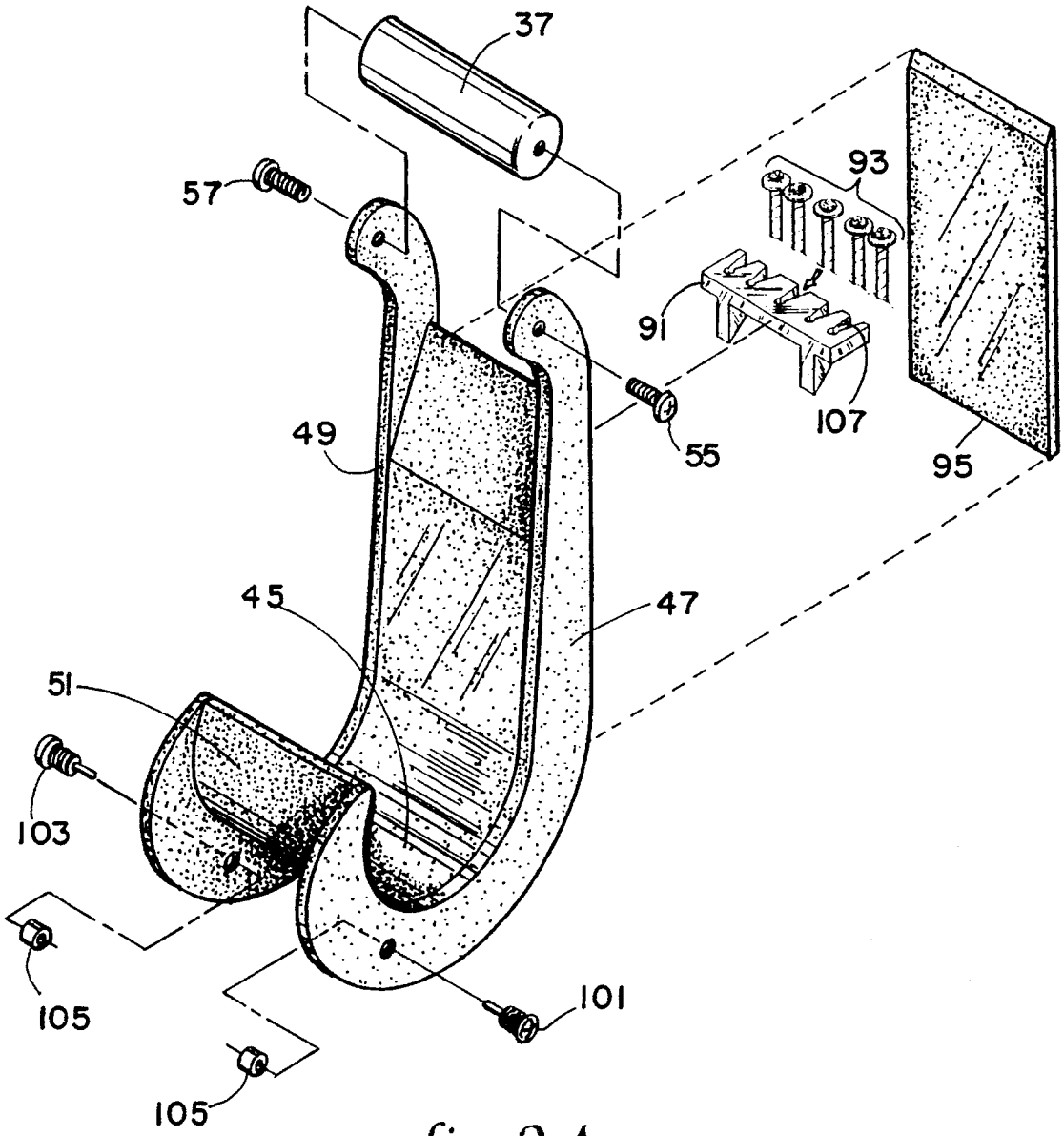
FIG. 2A is an expanded view of the upper exploded view shown in FIG. 2.

Referring to FIG. 2A, an expanded view of the pivoting member 31 and its associated structures are shown, which were discussed and shown in FIG. 1. In particular, the upper elastic rope bracket 91 is shown as having particular shaped notches 107. These notches 107 open significantly wider than the width of the elastic cord portion of the associated elastic cord upper ends 93, but narrow sufficiently to hold the elastic cord upper ends 93 in place. The elastic cord upper ends 93, like the elastic cord lower ends 63 have expanded diameter portions which may consist of an attached member, or simply a knot.

Figure 2B:
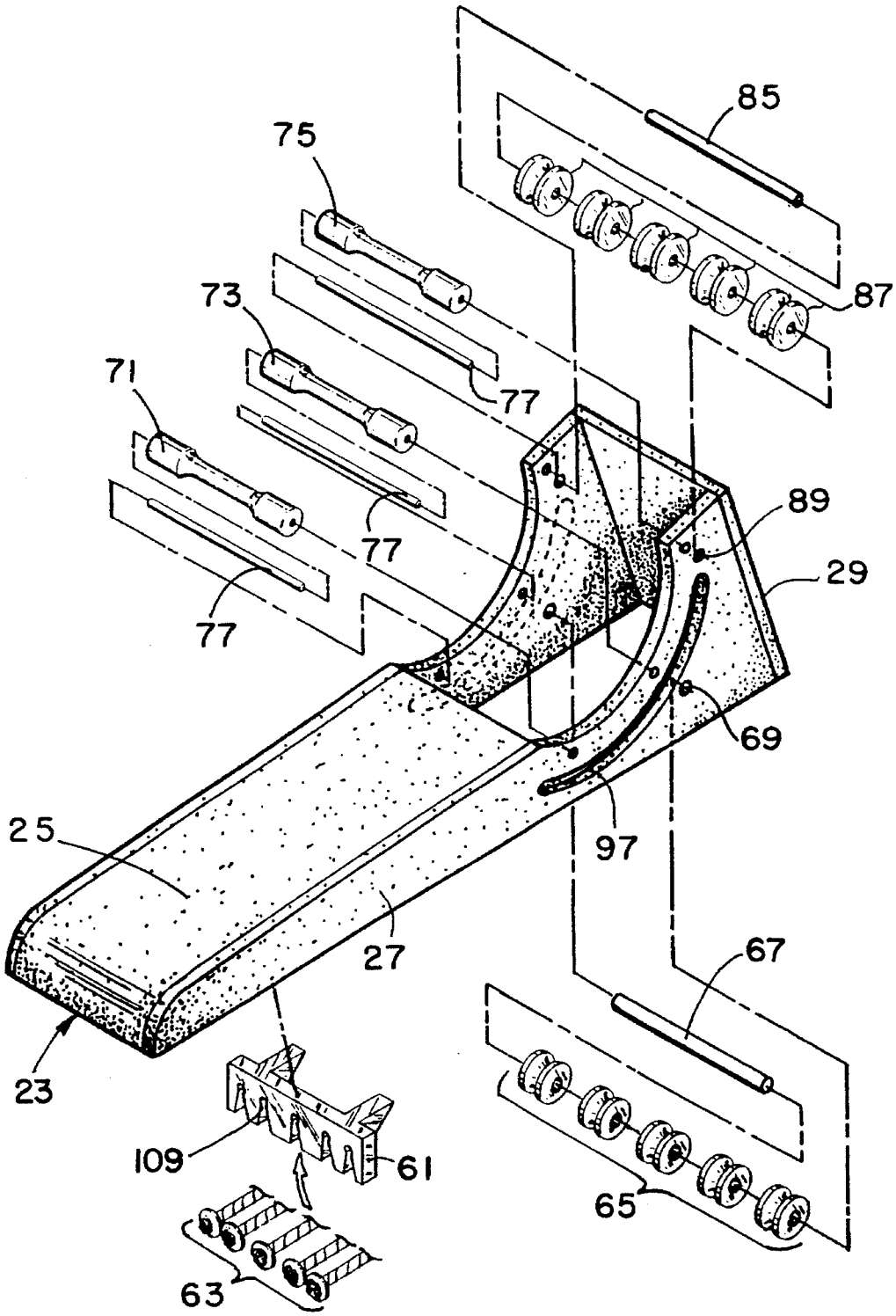
FIG. 2B is an expanded view of the lower exploded view shown in FIG. 2.

Referring to FIG. 2B, an expanded view of the base member 23 and its associated structures which were discussed and shown in FIG. 1 are illustrated. In particular, the lower elastic rope bracket 61 is shown as having particular shaped notches 109, similar to the notches 107.

Figure 3:
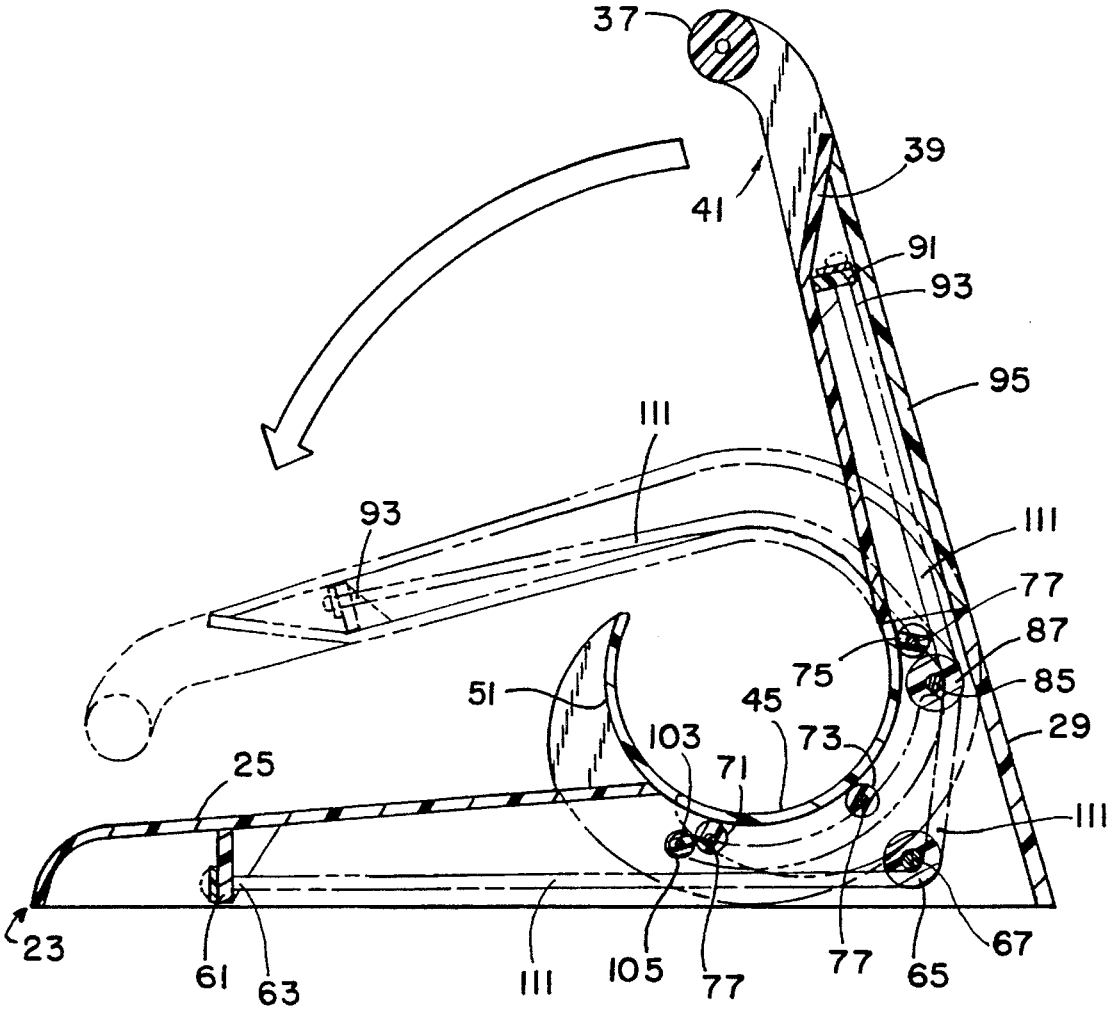
FIG. 3 is a cross section taken along line 3—3 of FIG. 1.

Referring to FIG. 3, a sectional view taken along line 3—3 of FIG. 1 is illustrated. Now seen in complete view, between the elastic cord upper ends 93 and the elastic cord lower ends 63, are the elastic cords 111. The view of FIG. 3 also illustrates the extent of the pivot of the pivoting member 31. The rest position is shown in solid line while the position of maximum force displacement is shown in phantom. As can be seen, in the maximum force displacement position, the elastic cord 111 is in its maximum length displacement.

As can also be seen, in the maximum length displacement, the cords 111 have some contact with radially outward surface 51. Because the cords 111 extend based upon a generally constant radius of extension, the force of opposition of the pivoting member 31 is more evenly proportional to the angular displacement of the pivoting member 31. The view looking into FIG. 3 is a view along the axis of the human arm humerus.

Thus it can be seen that the lower humerus and elbow will be protected as the pivoting member 31 is angularly displaced with respect to the base member 23. Also more clearly seen is hand opening 41 between hand grip 37 and slanted back wall 39.

While the present invention has been described in terms of an exercise and physical therapy device, one skilled in the art will realize that the structure and techniques herein can be applied to many such appliances. The present invention may be applied in situations where muscles and tendons associated with the axial angular displacement of a limb are needed to be strengthened.

Although the invention has been derived with reference to particular illustrative embodiments thereof, many changes and modifications of the invention may become apparent to those skilled in the art without departing from the spirit and scope of the invention. Therefore, included within the patent warranted hereon are all such changes and modifications as may reasonably and properly be included within the scope of this contribution to the art.

What is claimed:

1. A resistance device comprising:

a base member having a plurality of roller bearings and a pair of curvalinear slots; a pivoting member attached to said base member and engaging said plurality of roller bearings to be rotatable thereover, said pivoting member having grip means at which said pivoting member is manually grasped for imparting a rotational force to said pivoting member, a straight surface projecting from a curved surface that surrounds an axis of pivot, said straight and curved surfaces adapted to accept an elbow and arm of a user thereagainst, and a pair of opposing flanges bounding at least said curved surface for limiting the lateral movement of said pivoting member with respect to said base member, each curvalinear slot of said base member lying adjacent a respective one of said pair of flanges and each one of said pair of flanges having at least one aperture in alignment with a respective one of said curvalinear slots; said resistance device further comprising bearing screws depending from said apertures and continuing into said respective one of said curvalinear slots to ride in said curvalinear slots and to pivotally attach said pivoting member to said base member; and at least one resilient member, connected between said base member and said pivoting member and providing urging force to said pivoting member in a first direction proportional to displacement in a second direction.

2. The resistance device recited in claim 1 wherein said at least one resilient member is at least one elastic cord having a first end connected to said base member and a second end connected to said pivoting member.

3. The resistance device recited in claim 2 wherein said at least one elastic cord has enlarged ends, and further comprises:

a base bracket, attached to said base member and having at least one notch for engaging one of the enlarged ends of said elastic cord; and a pivoting member bracket, attached to said pivot member and having at least one notch for engaging the other one of the enlarged ends of said elastic cord.

4. The resistance device of claim 1 wherein said grip means further comprises a hand grip, positionally fixed with respect to said straight surface of said pivoting member and spaced apart from the axis of pivot of said pivoting member, and defining a hand opening with respect to said pivoting member.

5. The resistance device as recited in claim 1 wherein said base member extends away from engagement with said pivoting member, and forms an first wider angle with said pivoting member, said pivoting member angularly displaceable toward said base member.

6. A device for exercising the arm comprising:

a base member having a plurality of axially parallel roller bearings aligned in a radial configuration and supported by said base;

a pivoting member engaging said plurality of roller bearings to be rotatable thereover, said pivoting member having a straight surface projecting from a curved surface to accept an elbow and arm of a user, and said pivoting member having a pivot axis and being pivotally attached to said base member by a pair of bearing screws, each bearing screw engaging a respective one of a pair of flanges connected to said curved surface of said pivoting member, and wherein said base member has a pair of curvalinear slots, each curvalinear slot being aligned with and accepting a respective one of said pair of said bearing screws to provide pivotal attachment of said pivoting member to said base member; and at least one resilient member, engaging said base member and said pivoting member and urging said pivoting member to a position of angular displacement away from said base member and enabling force to be applied to said pivoting member and enabling angular displacement of said pivoting member toward said base member upon the application of force opposing said at least one resilient member.

7. The resistance device recited in claim 6 wherein said at least one resilient member is a plurality of elastic cords having a first end connected to said base member and a second end connected to said pivoting member.

8. The resistance device recited in claim 7 wherein at least one of said plurality of elastic cord has enlarged ends, and further comprising:

a base bracket, attached to said base member and having at least one notch for engaging one of the enlarged ends of said elastic cord; and a pivoting member bracket, attached to said pivot member and having at least one notch for engaging the other one of the enlarged ends of said elastic cord.

9. The resistance device as recited in claim 6 wherein said base member extends away from engagement with said pivoting member, and forms a first wider angle with said pivoting member, said pivoting member angularly displaceable toward said base member.

* * * * *